United States Patent [19]

Moller

[11] Patent Number: 4,955,611

[45] Date of Patent: Sep. 11, 1990

[54] GOLF PRACTICE DEVICE

[76] Inventor: Bynum W. Moller, P.O. Box 688, Kerrville, Tex. 78029

[21] Appl. No.: 261,238

[22] Filed: Oct. 21, 1988

[51] Int. Cl.[5] ..... A63B 69/36

[52] U.S. Cl. ..... 273/195 A; 273/DIG. 13; 273/176 J

[58] Field of Search ..... 273/187 R, 195 R, 195 A, 273/195 B, DIG. 13, 186 R, 186 C, 176 H, 176 J

[56] References Cited

U.S. PATENT DOCUMENTS

| | | | |
|---|---|---|---|
| 3,690,673 | 9/1972 | Occhipinti | 273/176 H |
| 3,712,628 | 1/1973 | Boss | 273/195 A |
| 3,892,412 | 7/1975 | Koo | 273/176 H |
| 4,130,283 | 12/1978 | Lindquist | 273/195 A |
| 4,727,697 | 3/1988 | Vaux | 273/195 R |

*Primary Examiner*—George J. Marlo

[57] ABSTRACT

There is disclosed a golf practicing device for use in practicing hitting a golf ball off a mat made of a material which resembles grass covered earth. This mat "floats" on a fluid, either gas or liquid, which is contained in a bladder made of a flexible material. Also, this device is designed so that it will give the golfer the "feel" of the club contacting and taking a divot from the earth under the ball in actual golf play.

7 Claims, 1 Drawing Sheet

GOLF PRACTICE DEVICE

Figure 1:
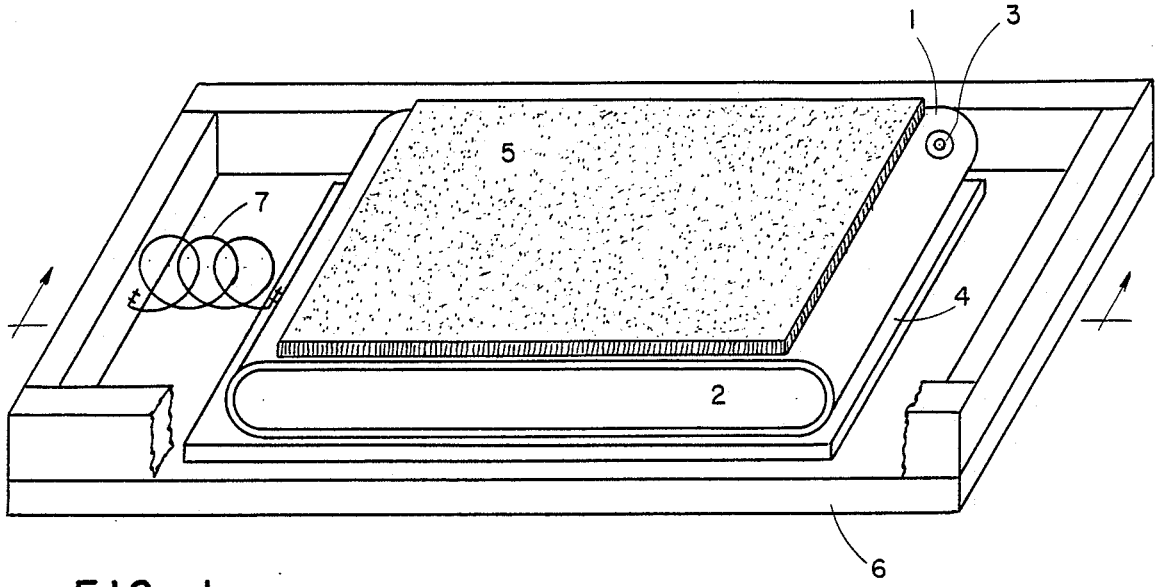

This invention relates to a "Practice Pad" made for the practice of hitting the golf ball with a golf club. The specially designed air cushion, on which the ball rests and from which it is hit, causes the golfer to get the "feel" of the club striking and taking a divot from grass-covered earth as he strikes the ball.

The relatively flat topped bladder, which is made of a flexible material such as rubber, forms a reservoir into which a gas or a liquid, or a combination of the two, is injected to form a cushion. In the preferred design the sides of this reservoir (see FIG. 1, part 2) are of thinner material than the remainder of the piece. With this construction the complete top (including the mat, part 5, which is made to simulate grass) can move laterally while the more flexible sides wrinkle and fold within these sides. The injected pressure can be varied to increase or decrease the rigidity of the pad top. The bottom of the pad then is adhered to a piece of a thin, rigid material. To make the device even more fluid in operation this complete part of the unit is made to slide on a main base or hinge so that it moves forward and downward when it and a golf ball are hit in practice.

Springs mounted in the base and attached to the mat-bladder unit return this unit to its original position after a golf ball is hit from the mat.

This Practice Pad then will be placed near a practice field into which the golf balls will be projected.

There is known to the art many forms of Golf Practice Pads, all of which support the ball on some kind of mat. This mat usually is grass-like and is cushioned by some arrangements of springs. The provision of a fluid cushion placed under the mat is apparently unknown.

Patents disclosing the use of springs, foam and the like to support an artificial surface in a golf mat are as follows: Lambert, 1,276,775, 1918; Rosengarten, 2,124,123, 1938; Tone, 3,423,096, 1969; Lees, 3,473,811, 1969; Boss, 3,712,628, 1973.

In summary this invention comprises a Golf Practice Mat resting on top of a fluid filled bladder, and this unit resting loosely on a flat, rigid base or hinged to allow a forward and downward movement when hit by a golf club during practice.

It is accordingly an object of this invention to give a Golf Practice Pad with definite advantages over anything now known to the art or on the market.

A fuller understanding of the invention may be had by referring to the following description of the preferred embodiment and claims taken in conjunction with the accompanying drawings.

IN THE DRAWING

FIG. 1 shows in isometric the shape of the basic design of the Golf Practice Pad. The Bladder 1 is made of a flexible, rubber-like material with the Sides 2 preferably being thinner and thus more flexible. The top section of this pad can possibly be made to simulate grass covered earth. The Valve 3 (optional) is the type of flat fluid valve found in basketball bladders or the like. The desired volume of fluid may be trapped and sealed in as the bladder is made; or it may be injected through a hypodermic needle inserted through the bladder wall and then this small hole sealed. The Mat 5 is an Astroturf-type material which can be adhered to the top of the Bladder 1. The Bladder Base 4 is made of a rigid material and the Bladder 1 is adhered to this Base.

These three pieces make up what will be referred to as the Unit A. The Base Board 6 on which this Unit A rests is also made of a rigid material and is compatible for contact and for sliding with the Bladder Base 4. The Spring 7 returns the Unit A back to its original position after it has moved to the left as a result of being struck by a Golf Club.

It can be understood that when a golf ball is placed on the mat and then the golf ball and this mat are struck simultaneously with a golf club moving in a downward and to the left direction, the mat is compressed into the fluid cushion of the bladder and the complete Unit A moves to the left and into the Spring. The Spring then pushes the Unit A back to the striking position and thus affecting a complete cycle.

Figure 2:
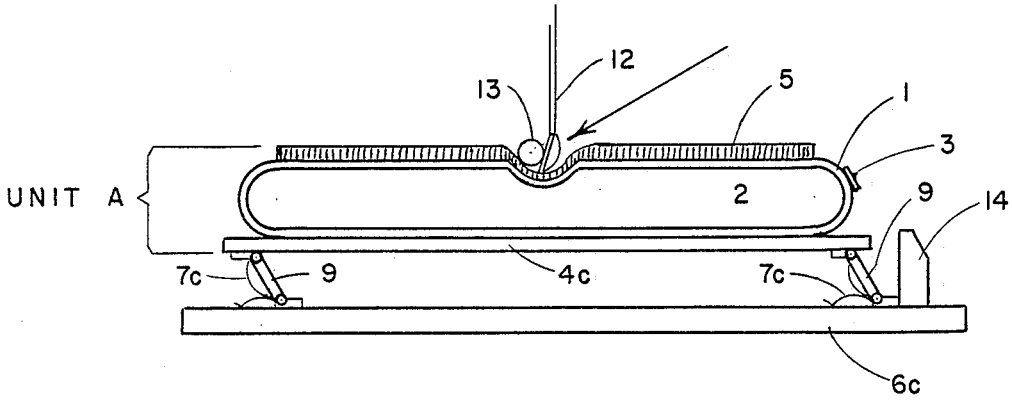

FIG. 2 shows the preferred alternate arrangement of the complete unit where the Unit A is mounted on two double (or Z-shaped) Hinges 9 which are attached to the Bladder Base **4*c* at the top leg and to the Base Board 6*c* at the bottom leg. In this drawing the hinges are shown partially straightened as Unit A moves to the left. Coil Springs 7*c* are mounted with the coil center at the lower pivot of the hinges with one end of the spring bearing on the Base Board 6*c* and the other end bearing against the middle member of the double hinges 9. The Stop Block 14 is mounted permanently to the Base Board 6*c*. During the static phase of practice this spring holds the Unit A against the Stop Block 14 and the Hinges 7*c* are held with the middle member at or near vertical. When the golf Club 12 hits the golf Ball 13 and Mat 5 in a downward and from right to left direction (see long arrow for approximate course of the golf Club) the Air Cushion 1 compresses and the complete Unit A hinges forward and downward to allow the golf club to clear the Mat 5 more quickly than with the unit as shown in FIG. 1. After the golf ball has been hit and Unit A has been forced to the left and downward, the Springs 7*c* force this unit upward and to the right to it's original position, back into contact with the Stop Block 14**. With this arrangement then the golfer's "feel" of "taking a divot" can be controlled by varying the total weight of Unit A.

Figure 3:
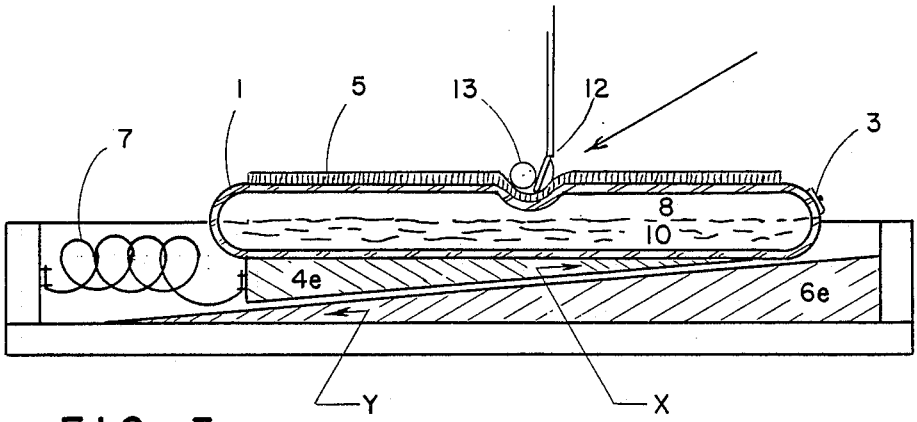

FIG. 3 shows another alternate arrangement of the complete unit in cross section with a possible two-fluid combination of Air 8 and Liquid 10 in the Bladder **1*a*. The Bladder 1*a* with Mat 5*a* is mounted on and adhered to a triangular shaped Base Block 10 with it's angle X equal to the tilt angle Y of the Tilted Base Board 6*a*. The Mat 5*a* then will be in a horizontal attitude. With this base tilt the Golf Club 12 will clear the Mat 5*a* more quickly and thus the golf stroke will be made freely and more smoothly than with the unit as shown in FIG. 1**. The long arrow shows the approximate course of the golf club as it is driven into the mat and pad.

I claim:

1. A golf practice device comprising a fully enclosed, air filled, flexible cushion with the top and bottom parts being relatively flat and parallel, with the top surface of the top part including a mat of upstanding, grass-simulating bristles, and being sufficiently durable to withstand being struck by a golf club, with two pairs of relatively parallel sides, and with a rigid base piece to which the bottom surface of said cushion is attached the combination of said mat, cushion and rigid base defining an integral unit adapted to fit on a sub base which is shaped to receive said unit and allow it to move forward thereon as a unit when the mat is struck by a golf club.

2. The golf practice device of claim 1 with a mat made to simulate grass covered earth resting on or secured to the top of the cushion.

3. The golf practice device of claim 1 wherein the fluid cushion is made of a flexible rubber-like material.

4. The golf practice device of claim 1 with means for injecting air into said cushion.

5. The golf practice device of claim 1 wherein two opposing and relatively vertical sides are sufficiently flexible to fold as the top surface is moved horizontally and downwardly in a direction parallel to these two sides.

6. The golf practice device of claim 1 with means for returning said integral unit to its original position after it has been hit and moved by the golf club during the golf swing.

7. The method of using the device recited in claim 1 comprising the step of driving a golf ball from the top surface of said device.

* * * * *